United States Patent [19]

Williams

[11] Patent Number: 4,645,458

[45] Date of Patent: Feb. 24, 1987

[54] ATHLETIC EVALUATION AND TRAINING APPARATUS

[75] Inventor: Jerry R. Williams, Prescott, Ariz.

[73] Assignee: Harald Phillip, Beaverton, Oreg.

[21] Appl. No.: 723,352

[22] Filed: Apr. 15, 1985

[51] Int. Cl.[4] ..... A63B 69/00

[52] U.S. Cl. ..... 434/251; 273/55 R; 273/1 GE; 272/100

[58] Field of Search ..... 434/251, 253, 255, 247; 273/1 GE, 1.5 A, 55 R, 1 G; 272/71, 73, 100, 101, 104, 105

[56] References Cited

U.S. PATENT DOCUMENTS 3,492,582 1/1970 Heywood ..... 434/255

3,846,704 11/1974 Bessette ..... 434/255

*Primary Examiner*—Richard C. Pinkham

*Assistant Examiner*—Stuart W. Rose

*Attorney, Agent, or Firm*—Don J. Flickinger; Jordan M. Meschkow

[57] ABSTRACT

This relates to a method and apparatus for testing and enhancing a football player's ability to quickly react to visual stimuli. When the player leaves a starting position, first and second timers begin counting. When the player reaches a first reaction point, the first counter is stopped thus containing an indication of how long it took for the player to reach the first reaction point. Simultaneously therewith, one of a battery of lights is energized indicating to the athlete that he must undertake and complete a particular action. This action may represent a cut right or cut left or may require the athlete to throw a ball at a particular target. The second timer is stopped when all the required actions have been completed thus giving an indication of how long it took the player to run the entire course.

2 Claims, 5 Drawing Figures

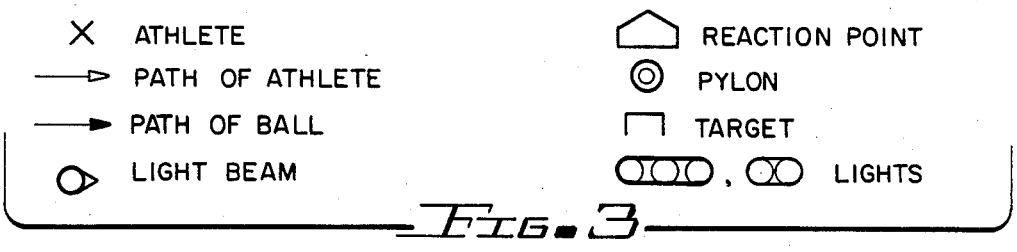
FIG. 3
FIG. 4
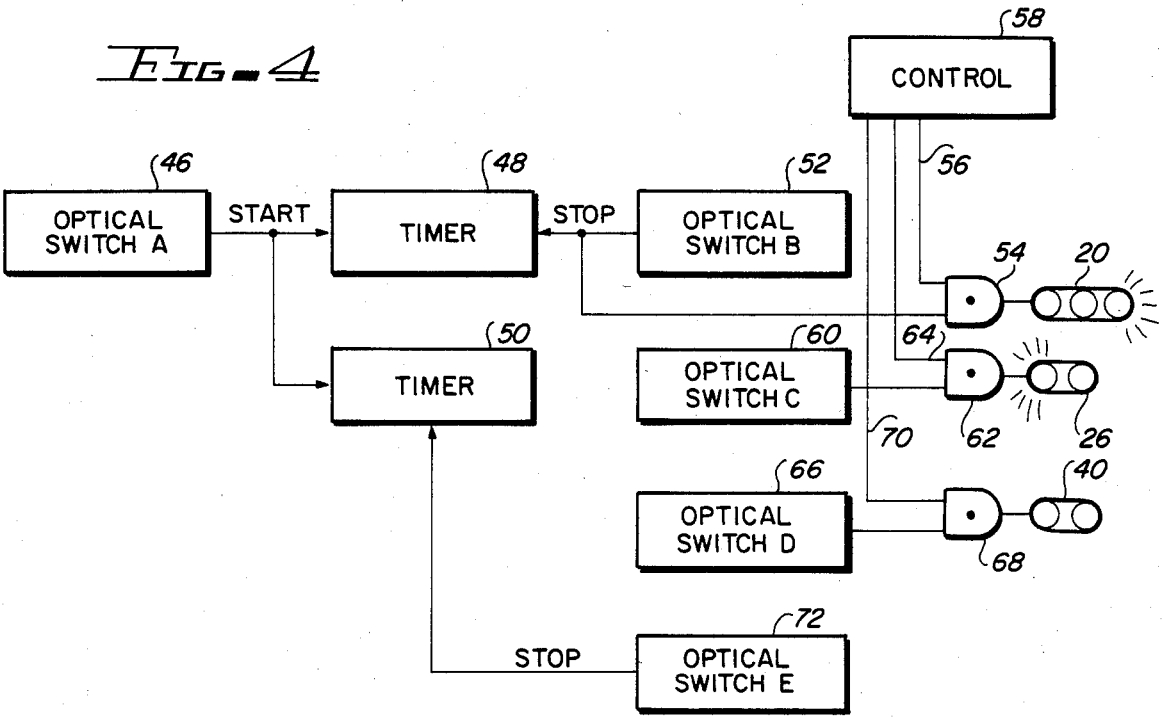
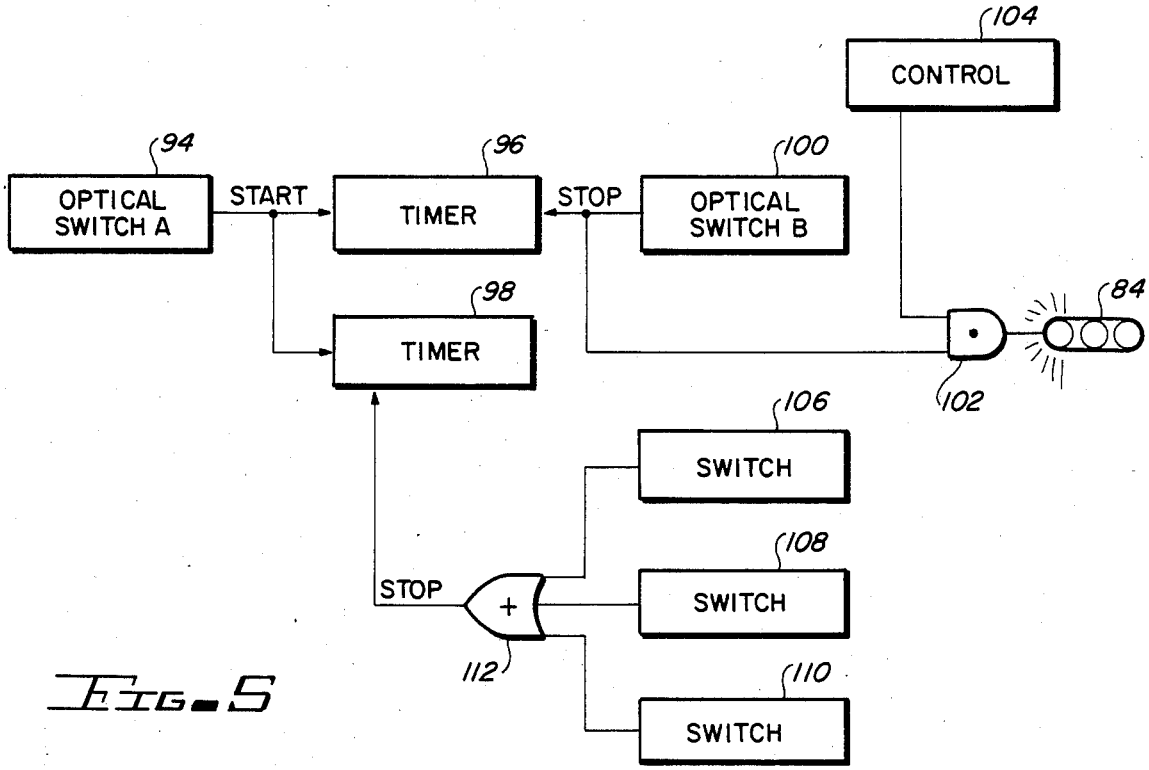
FIG. 5

ATHLETIC EVALUATION AND TRAINING APPARATUS

BACKGROUND OF THE INVENTION

FIELD OF THE INVENTION

This invention relates generally to the art of training athletes, and more particularly to an apparatus and method for electronically evaluating, under controlled conditions, an athlete's speed, agility, body control, and ability to react to visual stimuli.

One of the major goals in training athletes, especially football players, is to develop speed, coordination, lateral movement, peripheral vision, and the ability to quickly change direction ("cut"). Typically, the forty yard dash is used to measure the speed of running backs, linemen, linebackers, defensive backs, etc. However, the forty yard dash is a flat out, straight ahead sprint which does not test the athlete's reaction time, peripheral vision, lateral movement or ability to cut.

Certain training aids have been developed. For example, U.S. Pat. Nos. 3,534,958 and 4,029,315 disclose apparatus for testing a player's passing ability. U.S. Pat. No. 3,096,979 discloses an agility developing device wherein one or more players respond to one or more moving targets. Unfortunately, such devices have very limited application and do not measure nor enhance the player's reaction time and ability to quickly change direction in response to visual stimuli.

U.S. Pat. No. 3,912,259 entitled APPARATUS FOR TIMED EVENTS PERFORMED BY CYCLISTS, issued Oct. 14, 1975 discloses an obstacle course for timing events undertaken by cyclists. The cyclist initially proceeds over an actuator which starts a stopwatch, proceeds around various objects or obstacles and eventually returns such that the entire event can be timed. The obstacles are painted either yellow or orange to indicate that the cyclist should pass to the right or left of the obstacle or marker. This arrangement does not provide, however, any means for redirecting the cyclist in another direction on a real-time basis and therefore does not test or improve his reaction time and ability to quickly respond to visual stimuli.

SUMMARY OF THE INVENTION

It is an object of the present invention to provide an improved evaluation training method for training athletes.

It is a further object of the present invention to provide a testing and training method for athletes which will evaluate and develop the athlete's reaction time and ability to change direction in response to visual stimuli.

It is a still further object of the present invention to provide an improved evaluation and training method for athletes including an obstacle course, the nature of which can be electronically varied.

Another object of the present invention is to provide an athletic testing method including an obstacle course which may be easily controlled by the coach or trainer.

Yet another object of the present invention is to provide an improved evaluation method for football players which does not require contact with the player's body and thus minimizes the possiblity of injury.

It is a further object of the present invention to provide an improved training method for football players which may be utilized to develop offensive, defensive and passing abilities.

Yet another object of the present invention is to provide an improved method for evaluating athletes, especially football players, which is radio controlled.

Another object of the present invention is to provide an evaluation and training method for training football players which utilizes an obstacle course having a plurality of electronically selectable paths.

It is a further object of the present invention to provide an improved training method for testing athletes such as football players which includes means for automatically recording the test results of the players.

The present invention utilizes an obstacle course which involves different paths; e.g. to the right and left of a central path. A starting position is designated including an optical switch energized by a light beam. Upon a given command from the trainer or coach, the athlete begins his test by first running through the light beam. This causes the first optical switch to start two timers.

The athlete proceeds to a first reaction point which includes a second optical switch and light beam. When the second light beam is broken, the second optical switch causes the first timer to stop and further causes one of a battery of spaced apart lights which are located near the first reaction point to begin flashing. The direction in which the athlete is to proceed is indicated by which of the lights is flashing. For example, if the light on the right is flashing, the athlete must cut right. If the light on the left is flashing, the athlete must cut left. If the center light is flashing, the athlete must proceed in a straight ahead fashion.

The athlete proceeds in the direction indicated by the first battery of lights until he reaches a second reaction station whereupon he breaks a third light beam which is activating a third optical switch. Again, the direction in which the athlete is to proceed will be indicated by a flashing light. For example, depending on whether the right or left light is flashing, the athlete will know whether or not to cut around a selected one of two pylons.

Finally, the athlete proceeds to the finish line where he breaks a fourth light beam and triggers a fourth optical switch. This switch stops the second timer indicating how long it took the player to proceed through the entire course. To provide complete versatility, the same general types of paths and alternate routes are provided on the right and left sides of the central path so that an athlete's ability to cut in either direction may be evaluated.

According to a broad aspect of the invention there is provided a method for testing and training an athlete, comprising measuring the length of time it takes the athlete to manouver from a starting position to a first reaction point; and selecting one of a plurality of possible visual indications to be generated at the first reaction point to which the athlete must respond by undertaking and completing a pre-determined action.

According to a further aspect of the invention there is provided an method for testing and training an athlete, comprising a first timer; first means coupled to the first timer for starting the first timer when the athlete leaves a starting position; second means coupled to the first timer for stopping the first timer when the athlete reaches a first reaction point; and third means for generating an indication at the first reaction point to which the player must respond by observing the indication and responding thereto by completing a particular action.

The above and other objects, features and advantages of the present invention will be more clearly understood from the following detailed description taken in conjunction with the accompanying drawings, in which:

BRIEF DESCRIPTION OF THE DRAWINGS

FIG. 3 is a legend identifying symbols used in FIGS. 1 and 2 so as to assist in the explanation thereof;

FIG. 4 is a funtional block diagram of the apparatus utilized in FIG. 1; and FIG. 5 is a functional block diagram of the apparatus utilized in FIG. 2.

DESCRIPTION OF THE PREFERRED EMBODIMENT

Figure 1:
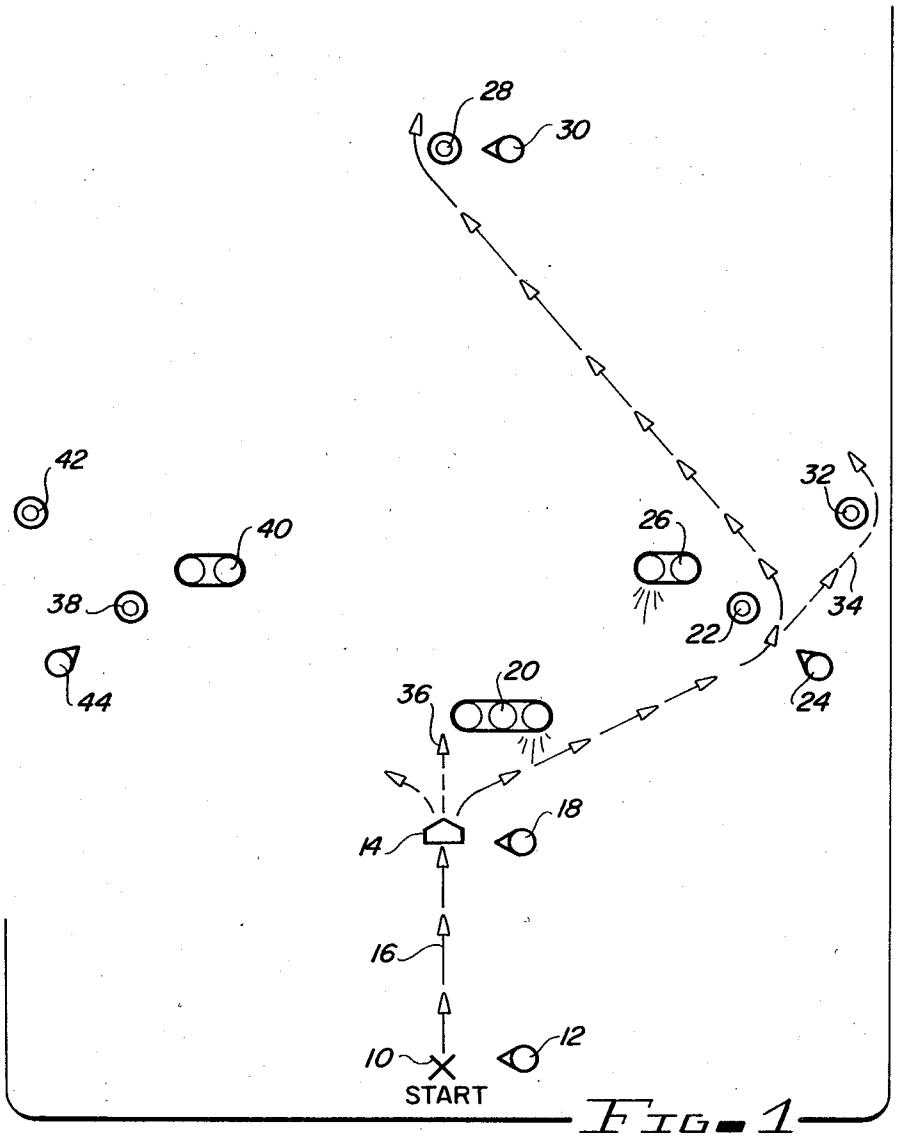

Referring now to FIGS. 1 and 3, athlete X begins the course at a starting point 10 by breaking a light beam 12. The breaking of light beam 12 causes an optical switch to start two timers as will be discussed in conjunction with FIG. 4. The athlete proceeds as quickly as possible to reaction point 14 as is indicated by arrow 16 at which point a second light beam 18 is broken. The breaking of this second light beam causes a second optical switch to cause one of the two timers to stop counting. In this manner, the athlete's speed from the starting point to the first reaction point 14 can be easily determined.

At reaction point 14, the athlete encounters a battery of lights 20. If the right light is flashing as is the case shown, the athlete should immediately cut right to pylon 22. At this point, a third light beam 24 is broken which activates a second battery of lights 26. If the left light is flashing as is the case shown, the athlete should cut left and proceed directly to pylon 28 at which a fourth light beam 30 is broken causing a fourth optical switch to stop the second counter. In this manner, the total time taken by the athlete to run the entire course may be determined.

Had the right light of light battery 26 been flashing instead of the left light, the athlete would have proceeded around pylon 32 as indicated by dotted arrows 34 prior to running to pylon 28. Similarly, if the center light of light battery 20 had been flashing when the athlete reached reaction point 14, the athlete would not cut right or left but would proceed straight ahead to pylon 28 as is indicated by dotted arrow 36. If the left light of light battery 20 had been flashing at reaction point 14, the athlete would cut left toward pylon 38 and, depending on which light of light battery 40 was flashing, to either pylon 42 or pylon 28. Light beam 44 breaks if the athlete is proceeding around pylon 38 which causes an optical switch to energize either the right or left lights of light battery 40.

It is intended that the lights of light batteries 20, 26 and 40 be remotely controlled by the trainer or coach from the side lines so as to, in effect, customize the course being run by the athlete. This results in a test of the athlete's speed plus his ability to proceed, cut right or cut left in response to visual stimulus.

FIG. 4 is a block diagram of the apparatus utilized in FIG. 1. As stated previously, when the athlete starts the course, a light beam 12 is broken causing optical switch A 46 to generate a signal which is supplied to timers 48 and 50 causing them to start counting. When the athlete reaches reaction point 14, an optical switch B 52 which is responsive to the breaking of light beam 18 causes timer 48 to stop counting. Thus, timer 48 contains a number indicative of the length of time it has taken the athlete to run from starting point 10 to reaction point 14. The output of optical switch B is applied to an AND function 54 and is used to gate a control signal appearing on line 56 from control unit 58 through AND function 54 to light battery 20. In this case, the signal appearing on line 56 passes through AND function 54 and causes the right lamp of light battery 20 to flash.

When light beam 24 is broken, an optical switch C 60 is combined in AND function 62 with a signal appearing on line 64 from control unit 48. The coincidence of the breaking of light beam 24 and the presence of a control signal on line 64 causes the leftmost lamp of light battery 26 to flash. Optical switch D 66 is activated when light beam 44 is broken thus generating an output which is applied to an additional AND function 68 for controlling, along with a control line 70 from control unit 58, which lamp of light battery 40 flashes. Finally, when light beam 30 is broken by the athlete passing pylon 28, regardless of the route taken by the athlete, an optical switch E 72 generates a signal which is applied to timer 50 to stop it. Thus, timer 50 contains a measurement indicative of the length of time taken by the athlete to run the entire course.

Control unit 58 may be a simple radio transmitter which is controlled by a plurality of two and three position toggle switches. The radio transmitter portion of control unit 58 would then generate signals for alterating the states of light batteries 20, 26 and 40. The toggle switches would enable the coach or trainer to pre-select a path through which the athletes are to proceed. A more sophisticated approach would be to have a control unit 58 comprised of a hand held computer and radio transmitter which would be operable for controlling the light batteries when the athlete breaks the light beams as described above. The hand held computer could be coupled to a printer for providing a printout of the results, including the athlete's name. Whether control unit 58 is a simple radio transmitter controlled by toggle switch or a microprocessor based computer system, is well within the capabilities of one skilled in the art to construct a control device for controlling the light batteries of the present invention.

Figure 2:
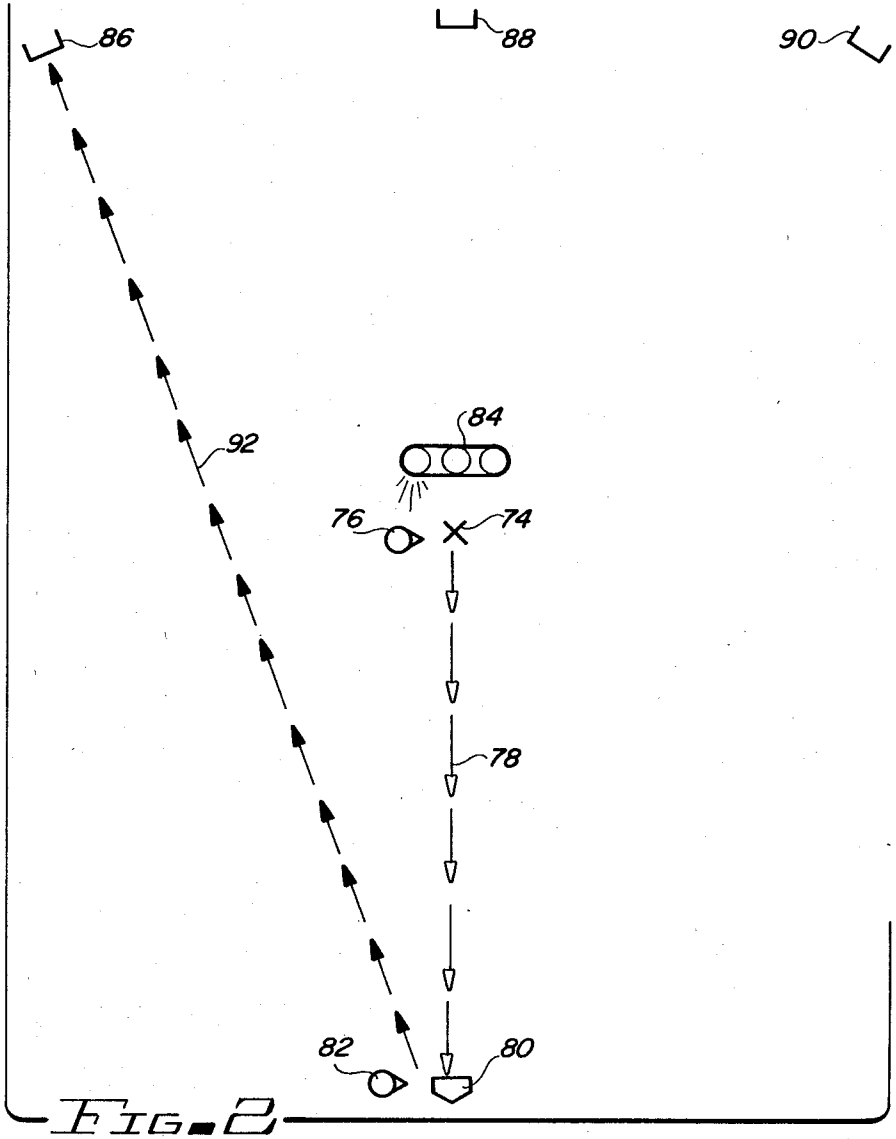
FIGS. 1 and 2 illustrate first and second examples of the deployment of the inventive training device and how it is utilized to evaluate and train a player.

FIG. 2 illustrates a second embodiment of the present invention which is particularly useful in the training and evaluation of quarterbacks. In this case, the player or quarterback 74 begins the test by moving backwards with a football in hand breaking the light beam 76. This causes first and second timers to begin counting. The quarterback continues moving backwards in the direction of arrows 78 until he reaches reaction point 80 and breaks a second light beam 82. The breaking of light beam 82 causes two things to happen. First, a signal is generated stopping the first timer giving an indication of the length of time it takes the quarterback to backpeddle from the starting point to the first reaction point 80. Second, one of the left, center or right lamps of light battery 84 is caused to begin flashing. The flashing lamp indicates to the quarterback which one of three targets 86, 88 or 90 he is to throw the football at. That is, if the right lamp is flashing the quarterback must throw the football at target 90. If the center lamp is flashing, the quarterback must throw the football at target 88. In the case shown in FIG. 2, the left lamp is flashing indicating to the quarterback that he must throw the football at target 86 as is indicated by arrows 92. If the football strikes the target, a switch coupled to the target causes a second timer to stop thus giving an indication as to the total length of time required for that quarterback to receiver a snap and hit the appropriate target.

FIG. 5 is a functional block diagram illustrating apparatus which would function to produce the course shown in FIG. 2. Upon breaking of light beam 76, optical switch A 94 generates a signal which causes timers 96 and 98 to begin counting. When the quarterback has backed up to reaction point 80, light beam 82 is broken which causes an optical swtich B 100 to generate a signal which stops timer 96. This signal is also applied to an AND function 102 as is a signal from control unit 104. The output of AND function 102 is applied to light battery 84 and lights an appropriate one of the three lamps, in this case the last one. Each of the targets 86, 88 and 90 is coupled to an impact switch 106, 108 and 110 respectively. When the football strikes the appropriate target, the appropriate switch will cause a signal to be applied via OR gate 112 to timer 98 in order to stop it. Thus, timer 98 will contain a measurement indicative of the length of time it took the quarterback to receive the snap and strike the appropriate target.

Thus the inventive training technique described above provides an obstacle course the nature of which may be varied in real time so as to test a player's ability to respond to visual stimuli.

The above description is given by way of example only. Changes in form and details may be made by one skilled in the art without departing from the scope of the invention as definded by the appended claims.

I claim:

1. A method for testing and training an athlete comprising:

measuring the length of time it takes an athlete to maneuver from a starting point to a reaction point;

providing a plurality of lamps for indicating a selection of predetermined actions to be executed at said reaction point including a first lamp for indicating a right cut and a second lamp for indicating a left cut;

energizing a selected one of said lamps to which the athlete must respond by observing said selected one of said lamps and by responding thereto by completing the respective said cut; and measuring the length of time it takes the athlete to complete the respective said cut after leaving said starting point.

2. A method for testing and training an athlete comprising:

measuring the length of time it takes an athlete to maneuver from a starting point to a reaction point;

providing a plurality of lamps for indicating a selection of predetermined actions to be executed at said reaction point including a first lamp for indicating throwing a ball at a first target and a second lamp for indicating throwing a ball at a second target;

energizing a selected one of said lamps to which the athlete must respond by observing said selected one of said lamps and responding thereto by throwing the ball at the respective said target; and measuring the length of time it takes the athlete to complete throwing the ball at the respective said target after leaving said starting point.

* * * * *